United States Patent [19]

Fujita

[11] 4,377,435

[45] Mar. 22, 1983

[54] LABELER

[75] Inventor: Mituo Fujita, Sakatoshi, Japan

[73] Assignee: Kabushiki Kaisha Shinsei Industries, Tokyo, Japan

[21] Appl. No.: 233,766

[22] Filed: Feb. 12, 1981

[30] Foreign Application Priority Data

Feb. 21, 1980 [JP] Japan ..... 55-20883

[51] Int. Cl.[3] ..... B65C 11/02

[52] U.S. Cl. ..... 156/384; 100/288; 156/577; 156/579; 156/584; 156/DIG. 48; 156/DIG. 49

[58] Field of Search ..... 156/384, 541, 577, 579, 156/584, DIG. 48, DIG. 49, DIG. 33; 101/287, 288, 291, 292

[56] References Cited

U.S. PATENT DOCUMENTS

| | | | |
|---|---|---|---|
| 3,265,553 | 8/1966 | Kind et al. | 156/384 |
| 4,008,119 | 2/1977 | Hermann | 156/541 |
| 4,144,809 | 3/1979 | Sato | 101/288 |
| 4,144,810 | 3/1979 | Sato | 101/292 |
| 4,176,603 | 12/1979 | Sato | 101/288 |

FOREIGN PATENT DOCUMENTS

| | | | |
|---|---|---|---|
| 1511892 | 6/1969 | Fed. Rep. of Germany . | |
| 2428998 | 1/1976 | Fed. Rep. of Germany | 156/384 |
| 2460444 | 6/1976 | Fed. Rep. of Germany | 156/384 |
| 50-15360 | 6/1975 | Japan . | |

*Primary Examiner*—Michael G. Wityshin

*Attorney, Agent, or Firm*—Wenderoth, Lind & Ponack

[57] ABSTRACT

A labeler in which a carrier strip onto which a number of labels are stuck is intermittently fed as far as specified by a carrier strip feeding mechanism provided in a case and turned back at the carrier strip turnback part to separate the labels in succession from the carrier strip and move ahead the labels one by one. The application member which comes in contact with the printed surface of the label is provided ahead of the carrier strip turnback part of the labeler and a label support frame which supports the label separated from the carrier strip is provided between the label application member and the carrier strip turnback part. The opening is provided at one side of the case and provided with a door and the carrier strip feeding mechanism is provided with at least one swing depression member which depresses the carrier strip against the carrier strip feeding drum, and the door of the opening is provided with an engaging member which depresses the swing depression member onto the carrier strip feeding drum and engages with the swing depression member.

7 Claims, 9 Drawing Figures

LABELER

BACKGROUND OF THE INVENTION

The present invention relates to a labeler in which the carrier strip which carries a number of labels stuck thereon in succession is turned back at a carrier strip turnback part and the labels are separated one by one from the carrier strip by intermittently feeding the carrier strip.

This type of conventional labeler, as described in the specification of the U.S. Pat. No. 3,265,553, is disadvantageous in that, since a label to be separated and forwarded from the carrier strip is held on the carrier strip while its rear end is still kept stuck to the carrier strip, a tension is applied to the label by the label sticking motion which is required when the label is to be stuck onto the surface of an article and the carrier strip is pulled out in the label forwarding direction from the carrier strip turnback part to unavoidably cause slackness of the carrier strip and therefore there is caused an error in the label feeding distance or deviated printing due to such slackness.

An object of the present invention is to provide a labeler in which a number of labels which are stuck in succession on the carrier strip are separated one by one from the carrier strip and moved ahead by turning back the carrier strip at the carrier strip turnback part so that the rear edge of each label is completely separated from the carrier strip and a force applied to the label when the label is to be stuck onto the surface of an article does not affect the carrier strip.

Another object of the present invention is to provide a labeler in which a label separated from the carrier strip is supported by the label support frame provided between the carrier strip turnback part and the label application member to ensure the label supporting position at all times.

Further, another object of the present invention is to provide a labeler in which the carrier strip feeding drum is provided with at least one swing depression member such as, for example, a swing depression piece or a swing guide member which depresses the carrier strip against the carrier strip feeding drum and the swing depression member is fixed by an engaging member which is provided on the door, which closes the opening at the lateral side of the case, when the door is closed.

SUMMARY OF THE INVENTION

The present invention provides the labeler which comprises a label tape consisting of a number of labels which are arranged in succession so that the front and rear edges of these labels contact each other and the labels stick to the carrier strip, a carrier strip turnback part which turns back the carrier strip, a carrier strip feeding mechanism which intermittently feeds as far as specified the carrier strip turned back by the carrier strip turnback part to separate and move ahead from the carrier strip to which the label is stuck, a label application member which is provided at a position away from the carrier strip turnback part and a label support frame which is provided between the carrier strip turnback part and the label application member, wherein said carrier strip turnback part is provided in conjunction with said label application member so that the rear edge of the label comes off from the carrier strip when the front edge of the label separated and moved ahead from the carrier strip reaches under the label application member and the label support frame is provided with a set of upper and lower frame pieces for supporting the label which comes off from the carrier strip turned at the turnback part, the upper frame piece contacting the printed surface of the label to prevent the label from being raised and the lower frame piece partly supporting the adhesive surface of the label. Furthermore, the present invention provides a labeler in which a carrier strip feeding mechanism is provided with a carrier strip feeding drum which engages with the carrier strip and feeds it, the drum is provided with at least one swing depression member which is remountably opposed on the outer periphery of the drum so that the swing depression member depresses the carrier strip against the drum, and the swing depression member is held by an engaging member such as, for example, a projection which is provided on a door which closes the opening provided in the case of the labeler so that the swing depression member is fixed while depressing the carrier strip against the carrier strip feeding drum when the door is closed.

DETAILED DESCRIPTION OF THE INVENTION

Figure 1:
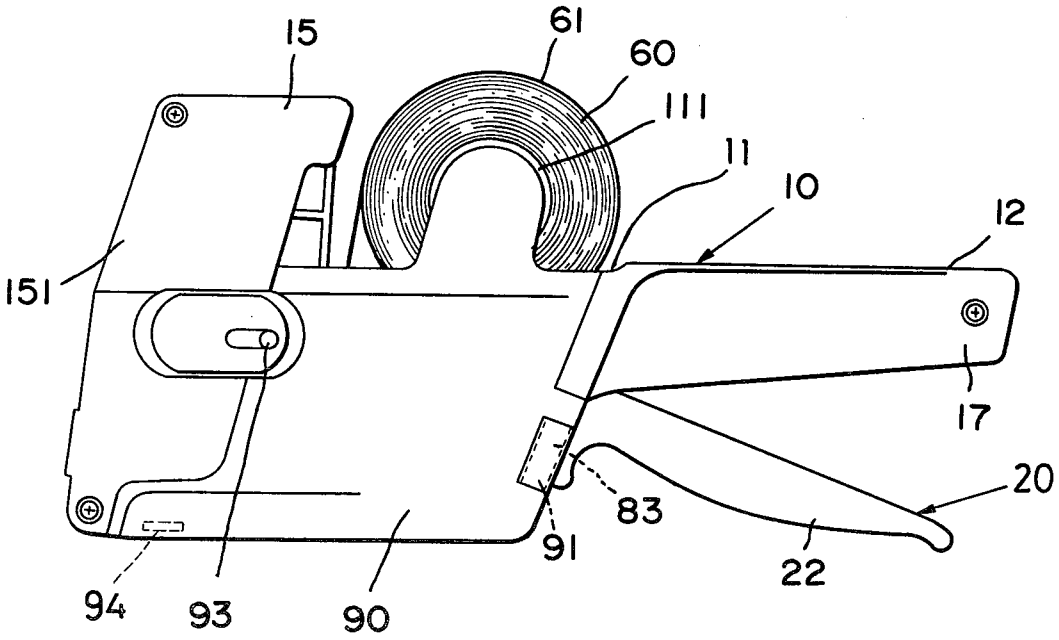
FIG. 1 is a side view of the labeler in accordance with the present invention.
Figure 2:
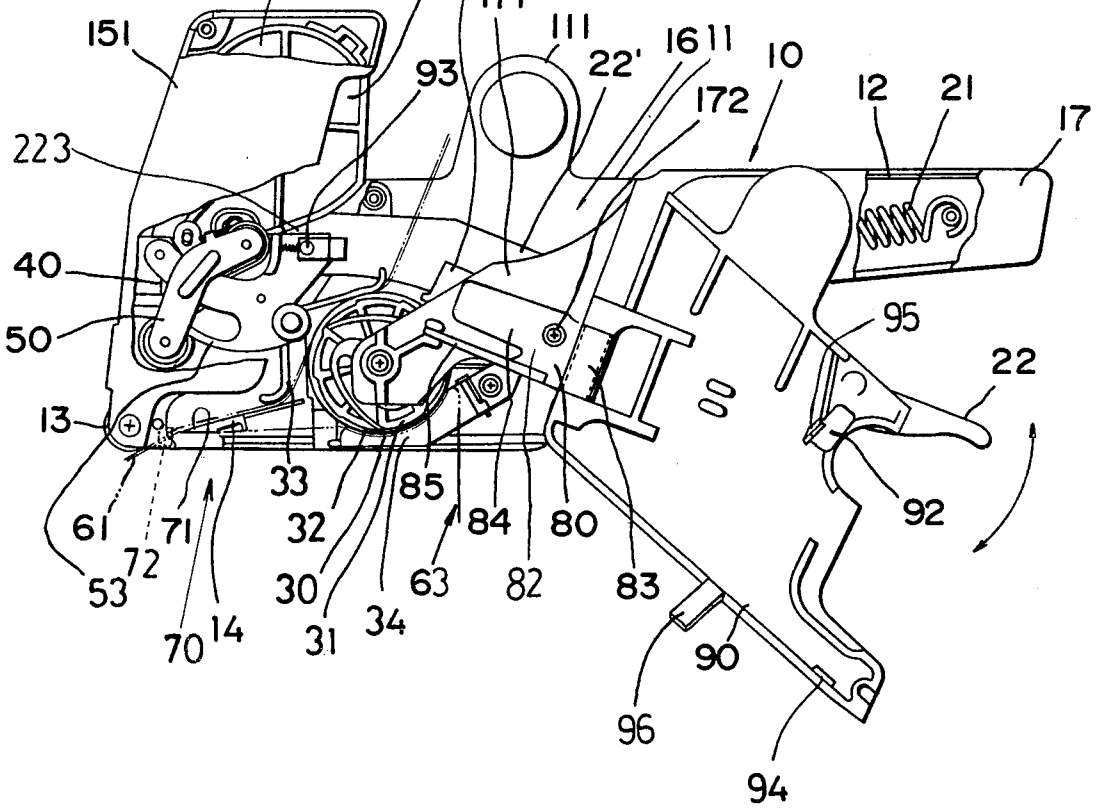
FIG. 2 is a partly cutaway side view illustrating the position of the labeler when the door of the labeler is opened.

In FIGS. 1 and 2, case 10 has a main frame 11 and a handle 12 and the main frame 11 is provided with a label tape holder 111.

Said case 10 is provided with an actuating mechanism 20, which is always urged away from the handle 12 of the case 10 by a reset spring 21 and has a lever 22 pivotally secured on the main frame 11 and this lever 22 is provided with an actuating means, for example, rack gear 221 which is provided on the operating part 22' of the lever 22 within said case 10 to actuate carrier strip feeding mechanism 30 during the swinging operation of the lever. The free end of the operating part is provided with a mounting part 223 on which a printing device 40 is mounted.

The carrier strip feeding mechanism 30 comprises a one-way clutch 31 which is driven by the rack gear 221 of said lever, feed drum 32 which is rotated in a specified direction only by the clutch 31, guide 33 and aligner 34, which is pivotally secured at its one end so as to enable its aligning part to closely approach and part from the carrier strip feed drum 32 and to depress the carrier strip 63 against the drum so as to prevent the carrier strip 63 from disengagement from the drum when the aligning part closely approaches the drum, as the swing depression members which operate to depress label tape 60 onto the feed drum 32.

The operation of said one-way clutch 31 is in accordance with the swinging direction of lever 22. Generally, clutch 31 idles during swinging of lever 22 toward handle 12 and then operates to rotate feed drum 32 during movement of lever 22 away from handle 12.

As illustrated in FIG. 2, guide 33 is pivotally mounted at its center on case 10 so that its two ends seesaw and, the upper end is moved toward drum 32 by clockwise rotation in the FIG. 2.

In this construction, the upper end of guide 33 is moved away from the drum 32 by pivoting the guide 33 counterclockwise in FIG. 2, so that label tape 60 having labels 61 can be inserted laterally between the guide and the drum 32, and the lower end of the guide 33 can then be automatically pushed up in the clockwise direction in FIG. 2 by pulling label tape 60 in the feed direction so as to urge the upper end of the guide 33 toward the drum 32, whereby label tape 60 will be pressed against the drum 32.

Figure 3:
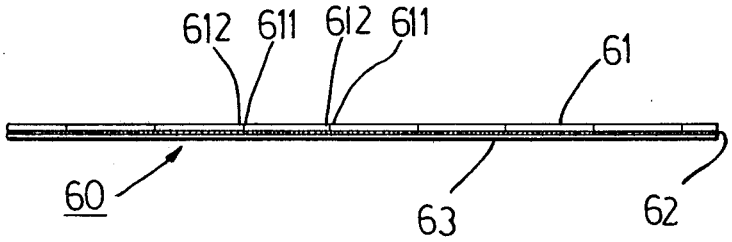
FIG. 3 is a side view illustrating a part of the label tape employed in the labeler in accordance with the present invention.

Said label tape 60 consists of a number of labels 61 and the carrier strip 63 to which said labels 61 are stuck with the adhesive layer 62 so that the front and rear edges 611 and 612 of the labels 61 are connected each other in succession as shown in FIG. 3 and wound in the form of a roll and mounted on said label tape holder 111. Label 61 is separated from carrier strip 63 and advanced by turning carrier strip 63 at carrier strip turnback part 71 of the label separating mechanism 70 and continuously feeding of the carrier strip 63.

Printing device 40 is mounted on the mounting part 223 of lever 22 and is provided with a holding frame 41 which rises and falls as lever 22 swings and with a printing mechanism provided in this holding frame 41.

The side frame plate which forms the part of the holding frame 41 toward the operating part 22' of the lever 22 has a mounting member thereon by which the printing mechanism is mounted on lever 22.

The printing mechanism has the required number of type belts which are arranged in parallel so that the printing faces of the printing mechanism, namely, the print types positioned at the lower end, can be varied and this construction is the same as of the known labelers.

Label (or carrier strip) receiving surface 14 is formed at main frame 11 so that said receiving surface is opposed to the printing face of said printing device 40 and said label receiving surface 14 is formed as an elastic member which is extended from the internal wall of the main frame and has free ends and can thus be deformed when it is impressed by the printing device 40.

Ink applying device 50 is provided adjacent to said printing device 40. This ink applying device 50 has a swing lever which is pivotally secured at one end on the inside wall of case 10, and is provided with an ink roller on the other end and the swing lever is tensioned by a spring, which is not shown in the figure, so that the ink roller is always urged into contact with print types of the printing device 40, and the swing lever is swung by the force of the printing device applied to the ink roller when the printing device 40 is lowered. This construction is also the same as of the known labelers.

The ink roller is guided by guide frame 53 made of a resilient material and can be demounted from the labeler by deforming this guide frame 53.

The label separating mechanism 70 has the carrier strip turnback part 71 to separate the label 61 printed by the printed device 40 from the carrier strip 63 and the label support frame 72 provided ahead of the carrier strip turnback part 71 to support the label 61 separated from the carrier strip 63.

Figure 4A:
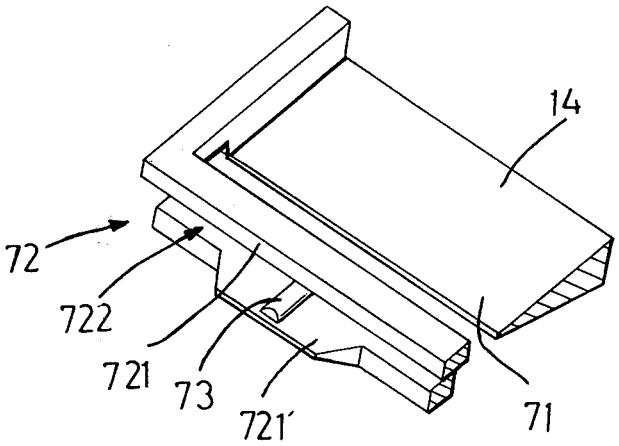
FIGS. 4A and 4B are respectively a partly cutaway perspective view illustrating the label support frame employed in the labeler.
Figure 4B:
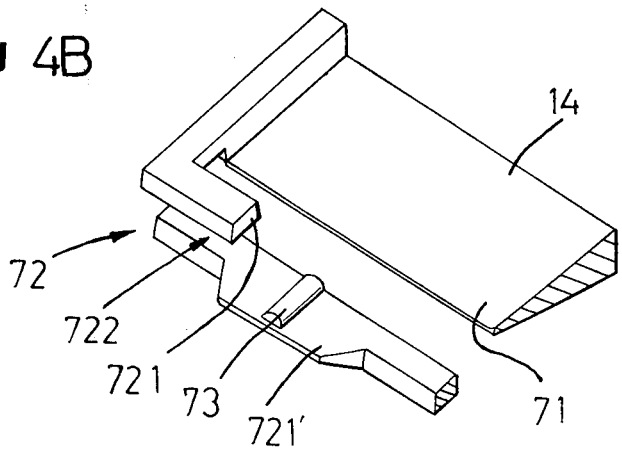

Label support frame 72 is provided with a set of frame pieces 721 and 721' which contact the label 61 separated and moved ahead from the carrier strip 63 at its upper and lower sides as shown in FIGS. 4A and 4B and the label passage 722 formed between these frame pieces. The label support frame 72 is adapted so that the upper frame piece 721 engages with the rear edge 612 of the printed surface of label 61 and the lower frame piece 721' supports the rear part of the adhesive surface at its underside when the label 61 is completely separated from the carrier strip 63.

The labeler also includes a label application device such as impression roller 13. The carrier strip turnback part 71 is arranged away from the impression roller 13 so that the rear edge of the label 61 is completely separated from the carrier strip 63 and is still connected to the following label 61' with the adhesive layer 61 only when the label 61 is separated and moved ahead and its front part comes at a position under the label application member (the impression roller 13).

The lower frame piece 721' is provided with the label support projection 73 as shown in FIG. 4B which serves to support the label 61 by point or linear contact and is covered with an adhesion-proof material such as silicone as desired.

Printing device 40 is generally provided as specified in the embodiment of the present invention to print a blank label. Some labelers which use only preprinted labels are not provided with the printing devices 40.

Label support frame 72 can have the upper frame piece 721 which is long as shown in FIG. 4A or short as shown in FIG. 4B.

Figure 5A:
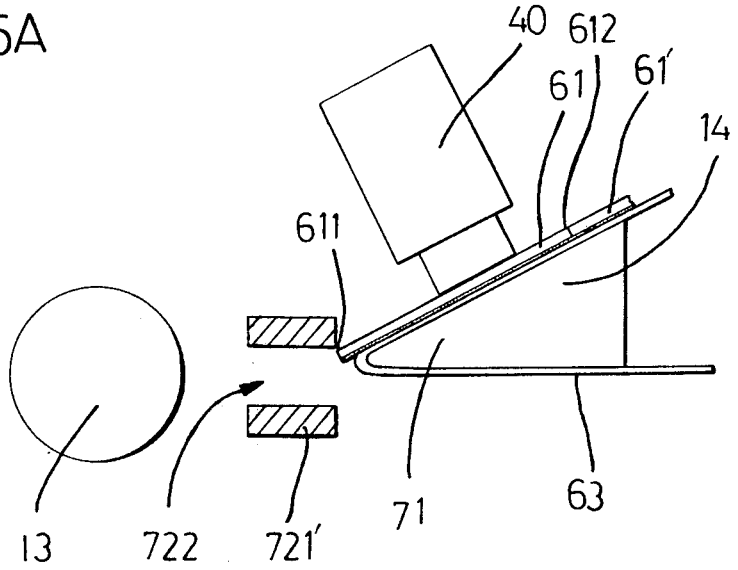
FIGS. 5A and 5B are respectively an explanatory view of the operation of the labeler in accordance with the present invention.

The labeler as described above operates as follows. When lever 22 is forced to approach handle 12, printing device 40 approaches label tape 60 on the label receiving surface 14, ink roller rubs the type face and moves out of the path of the downwardly moving printing device 40 and finally the printing device 40 comes in contact with label 61 of carrier strip 63 as shown in FIG. 5A.

When lever 22 is released and reset by reset spring 21, rack gear 221 operating as the actuating means drives one-way clutch 31 and carrier strip feed drum 32 which are kept coupled, and carrier strip feed drum 32 forwards carrier strip 63 by the desired amount, that is, the same as the length of label 61 while printing device 40 rises to its initial raised position and simultaneously ink applying device 50 is also reset.

Figure 5B:
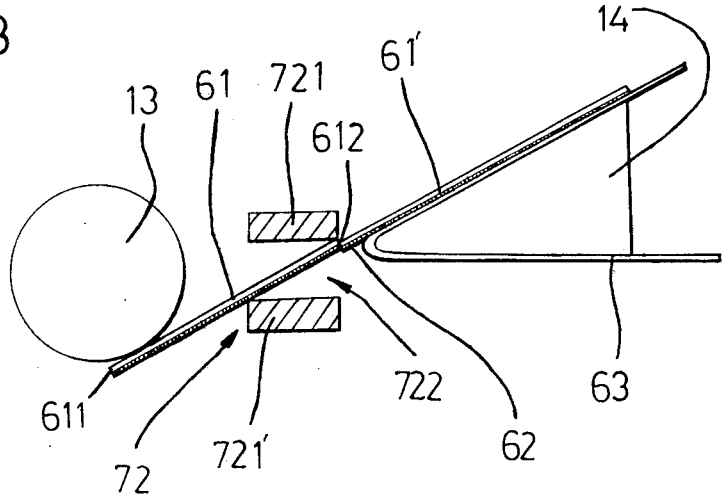

The carrier strip 63 is turned back at the carrier strip turnback part 71 and the label 61 stuck on the carrier strip 63 is peeled off for its proper resilience and forwarded to the impression roller 13 through the space 722 in the label support frame 72 as shown in FIG. 5B and stopped when the rear edge 612 of the label is separated from the carrier strip 63.

In this case, the label 61 separated from the carrier strip 63 is connected to the following label 61' with the adhesive layer 62. As shown in FIG. 5B, the front part of the upper surface or the printed surface of the label 61 engages with the lower surface of the impression roller 13 and the rear part from the middle of the lower surface or the adhesive surface of the label 61 is supported by the label support projection 73 of the lower frame piece 721' of the label support frame 72, and moreover the rear edge 612 of the printed surface engages with the upper frame piece 721.

Figure 6:
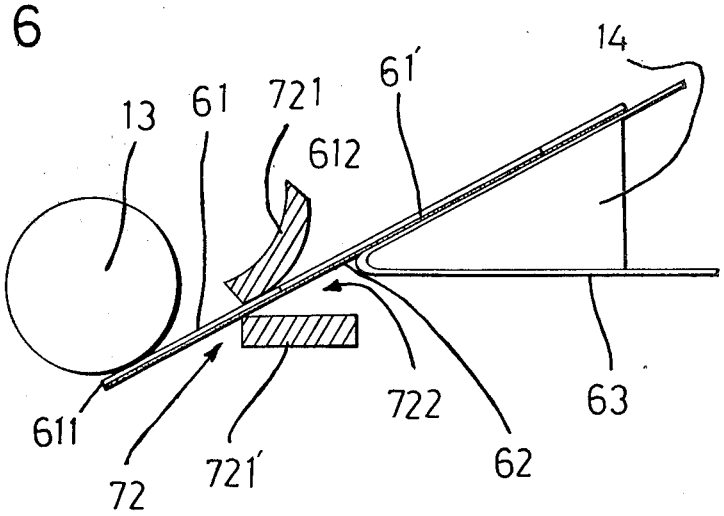
FIG. 6 is a cross sectional side view illustrating another embodiment of said label support frame.
Figure 7:
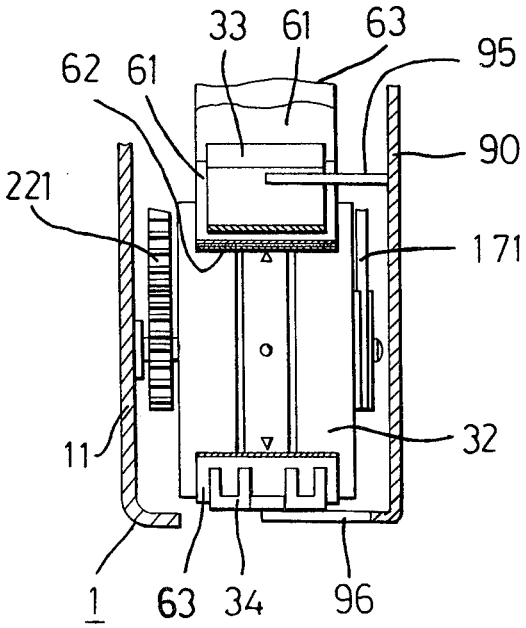
FIG. 7 is a front view of the carrier strip feeding drum illustrating an embodiment of the swing depression member employed in the labeler of the present invention.

Since the label 61 is prevented from coming off from the label support frame 72 because its rear part is restricted from rising, the label 61 is still supported by the label support frame 72 even though it is disconnected from the following label 61'. Label support frame 72 is satisfactory if the upper frame piece 721 engages with the upper surface of the label. For example, as shown in FIG. 6, the label support frame can be constructed to depress the label 61 as if the label is held by the upper and lower frame pieces from both sides without engaging with the rear part of the label 61.

Hereupon, in case of the side-openable type labeler, according to the present invention, the side part of case 10 of the labeler is preferably formed as a shock absorbing door as shown in the embodiment.

The door of this type of labeler has often been subject to shock due to dropping during setting the carrier strip or striking with other articles and therefore the hinge of the door has been deformed and the door could not be smoothly operated. This embodiment provides a manually-operated labeler capable of absorbing such external shock.

This labeler has a front chamber 15 which houses the printing device 40 in its front part and a central chamber 16 which houses the carrier strip feeding mechanism 30 at the lower part of the carrier strip holder 111.

Handle 12 of said case 10 has a handle cover 17 as shown in FIG. 2 and handle cover 17 is provided with projecting member 171 extended into the central chamber 16.

Carrier strip feeding mechanism 30 and actuating lever 22 are pivotally secured to projecting member 171 and an engaging claw which is not shown in the figure is provided on the body of actuating lever 22 whereby carrier strip feeding mechanism 30 is actuated as described above so that carrier strip 60 is fed as much as specified only when actuating lever 22 is returned to its initial position.

Support shaft 172 of the cover 17 which pivotally supports lever 22 together with a hinge structure 80 by which door 90 for closing and opening of the central chamber 16 is hinged.

Hinge structure 80 comprises a coupling structure such as, for example, shaft engaging groove 83 with a U-shaped horizontal cross section formed on an end of body 82 which is pivotally secured on the support shaft 172 and a vertical lug 84 and a horizontal lug 85 provided at the opposite end from shaft engaging groove 83 of the body 82. Vertical lug 84 is a resilient member which has a spring effect in the door opening and closing direction and is displaced by the internal surface of the door when door 90 is closed to urge the door outwardly, and said horizontal lug 85 is a resilient member which can be bent independently of vertical lug 84 and is arranged to resiliently oppose movement of shaft engaging groove 83 around support shaft 172 as a center. The extreme end of horizontal lug 85 is secured to the end of projecting member 171 of handle cover 17.

Door 90 is provided with a coupling part such as shaft 91 on the engaging edge located corresponding to the handle cover 17 which is fitted into shaft engaging groove 83 to be pivotally secured by hinge structure 80 with the coupling part, and a locking structure such as, for example, engaging part 92 is provided at the other end of the door to hold the door closed.

The front chamber 15 of case 10 is provided with cover 151 on which an operating structure such as, for example, push button 93 which engages and disengages engaging part 92 is provided.

Lug 94 is provided on the internal wall of door 90 to come at just below the label receiving surface 14 and is overlappingly opposed with a clearance to label receiving surface 14 when the door is closed, whereby excessive deformation of label receiving surface 14 is prevented by lug 94.

Moreover, door 90 is provided with at least one engaging member which engages the depressing swing member, that is, the guide 33 or the aligner 34. When the door 90 closes the opening of the case 10, the depressing swing member is fixed by the engaging member and thus the label tape 60 or the carrier strip 63 is firmly depressed onto the feed drum 32.

As the engaging member, the projecting member 95 which depresses the upper surface of the guide 33 to prevent its turning, and the projecting member 96 which simultaneously depresses the lower surface of the aligner 34 to prevent its turning when the door 90 is closed, can be provided on the door 90. The projecting member 96 can be a pin and, in this case, a hole which admits insertion of the pin can be provided in the side of the aligner 34 facing the door.

Since the labeler in accordance with this embodiment is constructed as described above, door 90 pushes vertical lug 84 which maintains the door in the closed position when door 90 is closed and engaging part 92 is locked by push button 93 and causes the door to swing to open when engaging part 92 is released.

In this case, door 90 protrudes slightly due to the spring effect of vertical lug 84 as soon as engaging part 92 is released and therefore a trigger is not required.

When door 90 is opened, central chamber 16 is open so as to be visible and carrier strip 60 can be loaded onto the carrier strip holder 111 and an end of the carrier strip can be pulled out and set in the carrier strip feeding mechanism 30 and carrier strip turnback part 71.

If an external shock is inadvertently applied to door 90 when it is open, door 90 is moved in the direction of the arrow shown in FIG. 2 and hinge structure 80 absorbs displacement of door 90 by the resilience of horizontal lug 85 and door 90 returns to its initial position after the shock is ended.

What is claimed is:

1. A labeler comprising:

a case having a carrier strip holder for holding a roll of carrier strip onto which a number of labels are stuck in succession and an opening provided on one side of said case;

an actuating mechanism having an operating part extended into said case and pivotally mounted on the case to be pivotable for movement with the case;

a carrier strip feeding mechanism having a carrier strip feed drum which is housed in said case and engaged with said carrier strip extended from said roll and driven by said operating part during movement thereof for feeding a fixed length of the carrier strip when said drum is driven by said operating part; and a carrier strip turnback part in said case around the edge of which the carrier strip is turned by the feeding motion of said carrier strip feeding mechanism for separating a label stuck onto the carrier strip, wherein there are provided at least one swing depression member which closely approaches and parts from the outer periphery of the drum of said carrier strip feeding mechanism and depresses the carrier strip against said carrier strip feed drum when said swing depression member closely approaches said drum, and an openable door which is provided to close the opening of said case and with an engaging member which secures said swing depression member on said drum when said door is closed;

wherein said engaging member is a projecting member which is provided on the internal surface of the door and engages with said swing depression member to depress it toward said carrier strip feed drum when the door is closed.

2. A labeler in accordance with claim 1, wherein said swing depression member is a guide provided between said carrier strip holder and said carrier strip turnback part whereby said carrier strip is depressed against said carrier strip feed drum while the label is kept stuck onto the carrier strip.

3. A labeler in accordance with claim 1, wherein said swing depression member is an aligner which depresses the carrier strip from which the label is separated against the carrier strip feed drum.

4. A labeler in accordance with claim 1, wherein a printing device is provided which is driven by the operating part of said actuating mechanism to engage and disengage from the label stuck on the carrier strip extended on said carried strip turnback part and carry out printing on the label before the label is separated from the carrier strip.

5. A device for applying to articles stick-on labels from a carrier strip comprising:

a case having an opening formed on one side thereof;

a carrier strip holder for holding a roll of carrier strip onto which a number of labels are stuck in succession;

means, includes a carrier strip feed drum housed in said case and engagable with the carrier strip extended from said roll, for feeding a fixed length of the carrier strip;

means, including an operating part extended into said case and pivotally mounted to said case, for driving said feeding means;

means, including a carrier strip turnback part in said case having an edge around which the carrier strip is turned by the feeding motion of said feeding means, for separating the labels stuck onto the carrier strip;

at least one swing depression member, closely approachable to and partable from the outer periphery of said drum of said feeding means, said at least one swing depression member depressing the carrier strip against said carrier strip feed drum when said swing depression member closely approaches said drum;

an openable door for closing said opening of said case; and an engaging member projecting from the internal surface of said door for engaging said swing depression member to depress said swing depression member toward said carrier strip feed drum and securing said swing depression member on said drum when said door is closed.

6. A device for applying to articles sick-on labels having printed surfaces from a carrier strip comprising:

a case having an opening formed on one side thereof;

a carrier strip holder for holding a roll of carrier strip onto which a number of labels are stuck in succession;

means, housed in said case and engagable with the carrier strip extended from said roll, for feeding a fixed length of the carrier strip;

means, including an operating part extended into said case and pivotally mounted to said case, for driving said feeding means;

means, including a carrier strip turnback part in said case having an edge around which the carrier strip is turned by the feeding motion of said feeding means, for separating the labels stuck from the carrier strip;

means, including a label application member mounted to said case, for engaging the printed surface of the label to depress the label onto an article, said application member engaging the leading edge of the lable simultaneously with the separation of the rear edge of the label from the carrier strip;

means, including a label support frame fixedly mounted to said case between said carrier strip turnback part and said lable application member, for supporting the labels upon separation from the carrier strip, said label support frame including an upper frame piece for engaging the printed surface of the label and a lower frame piece spaced from said upper frame piece for engaging an adhesive surface of the label such that said lable support frame supports the label while the label is separated from the carrier strip and the leading edge of the label simultaneously engages said label application member;

at least one swing depression member, closely approachable to and partable from the outer periphery of said drum of said feeding means, said at least one swing depression member depressing the carrier strip against said carrier strip feed drum when said swing depression member closely approaches said drum;

an openable door for closing said opening of said case; and an engaging member projecting from the internal surface of said door for engaging said swing depression member to depress said swing depression member toward said carrier strip feed drum and securing said swing depression member on said drum when said door is closed.

7. A device in accordance with claim 6, further comprising a printing device driven by said operating part to engage and disengage from the label prior to separation of the label from the carrier strip.

* * * * *

UNITED STATES PATENT AND TRADEMARK OFFICE

CERTIFICATE OF CORRECTION

PATENT NO. : 4377435

DATED : March 22, 1983

INVENTOR(S) : Mituo Fujita

It is certified that error appears in the above—identified patent and that said Letters Patent is hereby corrected as shown below:

Claim 1, line 8, change "with" to --within--.

Claim 6, line 1, change "sick-on" to --stick-on--.

Signed and Sealed this

*Fifth* Day of *July 1983*

[SEAL]

*Attest:*

GERALD J. MOSSINGHOFF

*Attesting Officer*

*Commissioner of Patents and Trademarks*